US007292216B2

(12) United States Patent
Yu et al.

(10) Patent No.: US 7,292,216 B2
(45) Date of Patent: Nov. 6, 2007

(54) CLOCK SIGNAL AMPLIFYING METHOD AND DRIVING STAGE FOR LCD DRIVING CIRCUIT

(75) Inventors: Jian-Shen Yu, Hsinchu (TW); Shih-Chian Liu, Taipei County (TW)

(73) Assignee: Au Optronics Corporation, Hsinchu (TW)

( * ) Notice: Subject to any disclaimer, the term of this patent is extended or adjusted under 35 U.S.C. 154(b) by 558 days.

(21) Appl. No.: 10/708,178

(22) Filed: Feb. 13, 2004

(65) Prior Publication Data

US 2005/0088397 A1 Apr. 28, 2005

(30) Foreign Application Priority Data

Oct. 24, 2003 (TW) ..... 92129519 A

(51) Int. Cl.
*G09G 3/36* (2006.01)

(52) U.S. Cl. ..... 345/100; 345/99

(58) Field of Classification Search ..... 345/98–100, 345/211, 87, 94

See application file for complete search history.

(56) References Cited

U.S. PATENT DOCUMENTS 5,646,642 A * 7/1997 Maekawa et al. ..... 345/99
6,300,927 B1 * 10/2001 Kubota et al. ..... 345/92
6,392,628 B1 * 5/2002 Yamazaki et al. ..... 345/98

* cited by examiner

*Primary Examiner*—Jimmy H. Nguyen
(74) *Attorney, Agent, or Firm*—Jianq Chyun IP Office

(57) ABSTRACT

A clock signal amplifying method and driving stage for LCD driving circuit is provided. The driving stage includes a clock input, a level shifter, and an output buffer. Firstly, the clock input receives a cock signal oscillating between a high original level and a low original level. Thereafter, a level shifter is biased at a high target level and a low target level, and amplifies the clock signal to a relay signal, which oscillates between a high relay level and a low relay level. Lastly, the output buffer is biased at the high relay level and the low relay level for amplifying the relay signal to a target signal, which oscillates between the high target level and the low target level.

4 Claims, 7 Drawing Sheets

CLOCK SIGNAL AMPLIFYING METHOD AND DRIVING STAGE FOR LCD DRIVING CIRCUIT

CROSS REFERENCE TO RELATED APPLICATIONS

This application claims the priority benefit of Taiwan application serial no. 92129519, filed Oct. 24, 2003.

BACKGROUND OF INVENTION

1. Field of the Invention

This invention generally relates to a clock signal amplifying method and driving stage for liquid crystal display (LCD) driving circuit, and more particularly to a clock signal amplifying method and driving stage for liquid crystal display (LCD) driving circuit that exerts low power consumption and stable performance.

2. Description of Related Art

To follow up modern lifestyle, video or image apparatus comes up with lightness and miniature. A conventional Cathode Ray Tube (CRT) partially shares advantages, yet it is voluminous due to the electronic gun feature. On the other hand, it takes too much space and as well as causes radiant problem. Therefore, the main stream of flat panel display is to integrate optoelectronics and semiconductor technologies for developing Liquid Crystal Display (LCD), Organic Light-Emitting Diodes (OLED) Display, or Plasma Display Panel (PDP).

Wherein the flat panel display field, an image of the LCD is composed of a plurality of pixels, arranging in a array, and the luminance of each of the pixels is controlled by both lightness of back-light module and grayscale. In a present driving method for LCD, the most common driving method is to keep a constant luminance of the back light module, and twist the crystal of each pixel by a bias voltage according to image information. Light transmittance is thereby determined with crystal twist angle, so as to display various grayscale.

A Thin Film Transistor (TFT) is a broad application device for LCD, for conducting or cut-off current. The driving circuit for the TFT display is to receive an image data, and hold the sampled image data for each of the pixels corresponding to LCD within a horizontal period. Thereafter, the driving circuit outputs a whole batch of image data at beginning or halfway of next horizontal period.

Referring to FIG. 1, it is a block diagram illustrating a conventional LCD driving circuit, where each driving stage includes a shift register 105, a level shifter 110, and an output buffer 115. Wherein the level shifter 110 is coupled to the shift register 105 and the output buffer 115. The clock signal of the shift register 105 swings between VDD (10V, for example) and GND. Since the shift register 105 operates at VDD and GND, whereas the level shifter 110 and the output buffer 115 operates at VDD and VSS, where VSS is negative voltage level. Therefore, the driving stage in conventional scheme relatively is power consuming on the clock propagation line due to a large clock swing.

Referring to FIG. 2A, it is a block diagram illustrating a driving stage of a conventional LCD driving circuit. The driving stage includes a first level shifter 203, a shift register 206, a second level shifter 209, and an output buffer 212. Wherein, the shifter register 206 couples the first shift register 203 to the second shift register 209. The output buffer 212 is coupled to the second shift register 209. The clock signal for the first level shifter 203 swings between a small range, between 3V and GND, for example. Referring to FIG. 2B, it is a diagram illustrating level shifting of a conventional LCD driving circuit. In the conventional scheme, the first level shifter 203 and the shift register 206 operates at VDD and GND for shifting 3V voltage level to VDD. The second level shifter 209 and the output buffer 212 operates at VDD and VSS for shifting GND to VSS level. According to a formula for dynamic power consumption: $P=fcV^2$, it is noted that power is in proportion to square of voltage level, wherein P is power consumption, f is operating frequency, c is loading capacitance, and V is signal amplitude. Therefore, this second conventional circuit consumes less power on the clock propagation line than the first convention circuit in foregoing description.

SUMMARY OF INVENTION

An object of the present invention is to provide a driving stage with a simple construction and driving method of a flat panel display that lowers dynamic power consumption on a clock line.

Another object of the present invention is to provide a clock signal amplification method of LCD circuit. Wherein a clock signal that swings between a high original level and a low original level is amplified to a target signal that swing between a high target level and a low target level. Where the high target level is higher than the high original level, the low target level is lower than the low original level. The method includes amplifying the clock signal to a relay signal that swings between a high relay level and a low relay level, and amplifying the relay signal to the target signal. Where the high relay level is between the high original level and the high target level, the low relay level is between the low original level and the low target level.

A driving stage of LCD driving circuit is provided in this present invention. The driving stage is connected in a cascade fashion to form partial of the LCD driving circuit. The driving stage includes a clock input, a level shifter, and an output buffer. Wherein the clock input is to receive the clock signal, which swings between the high original level and the low original level that periodically oscillates. The level shifter is coupled to the clock input, for receiving the clock signal and operates which at the high target level and the low target level, so as to amplify the clock signal to the relay signal that swings between the high relay signal and the low relay signal. The output buffer, coupling to the level shifter for receiving the relay signal, operates at the high target level and the low target level, and amplifies which to the target signal that swings between the high target level and the low target level.

Since two level shifters and three voltage sources are required by the conventional scheme, including GND, VDD, and VSS, number of thin film transistors is substantially high and circuit implementation is relatively complicated.

Therefore, only a driving stage with one level shifter and two voltage sources VDD and VSS are included in the driving stage of LCD driving circuit according to clock signal amplifying method and driving stage in the present invention.

The above is a brief description of some deficiencies in the prior art and advantages of the present invention. Other features, advantages and embodiments of the invention will be apparent to those skilled in the art from the following description, accompanying drawings and appended claims.

DETAILED DESCRIPTION

In a TFT-LCD, a gate driver is for continuously providing a pulsed signal to a gate coupling to each of the horizontal scanning lines. The gate is a terminal of a TFT switch controlling one pixel in an active array. Whereas the pulsed signal swings between negative voltage level VSS and positive voltage level VD, −5V to 9V, for example. A driving stage of the driving circuit in the present invention is for amplifying clock signal CLK_in at a low voltage, where the low voltage is usually 3V, and the clock signal CLK_in is a periodic signal swinging between 3V and 0V.

Figure 1:
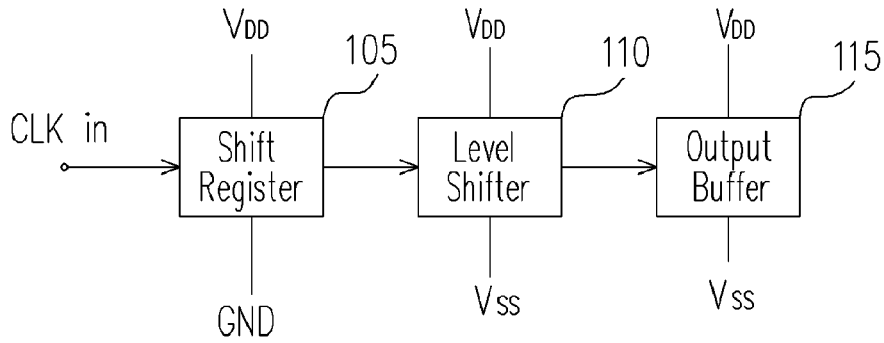
FIG. 1 (PRIOR ART)
FIG. 1 is a block diagram illustrating a driving stage of LCD driving circuit according to a conventional scheme.
Figure 2A:
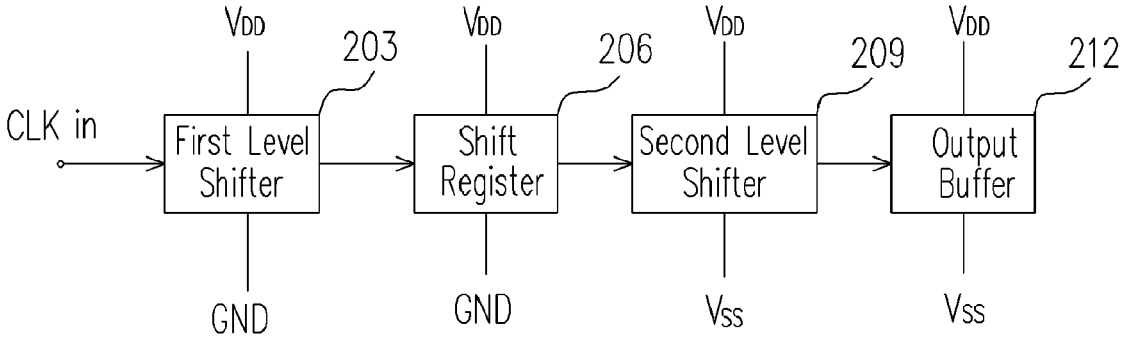
FIG. 2A(PRIOR ART)
FIG. 2A is a block diagram illustrating a driving stage of LCD driving circuit according to a conventional scheme.
Figure 2B:
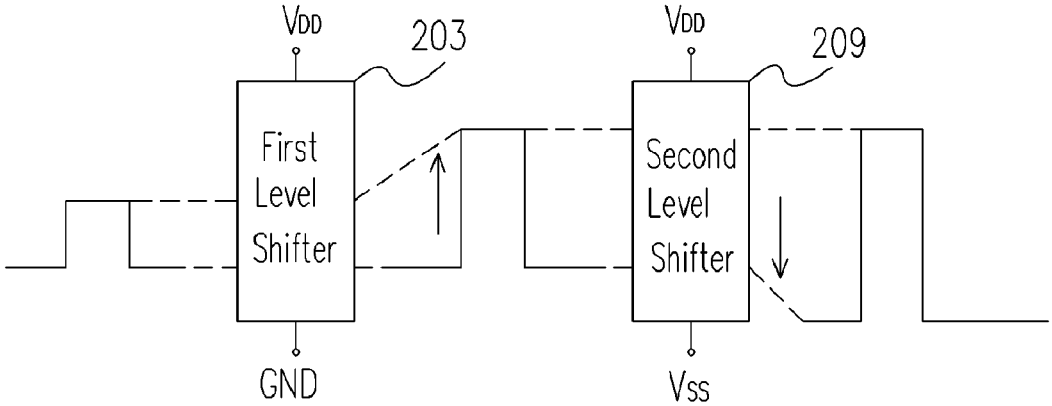
FIG. 2B(PRIOR ART)
FIG. 2B is a diagram illustrating level shifting of a driving stage for LCD driving circuit according to a conventional scheme.
Figure 3:
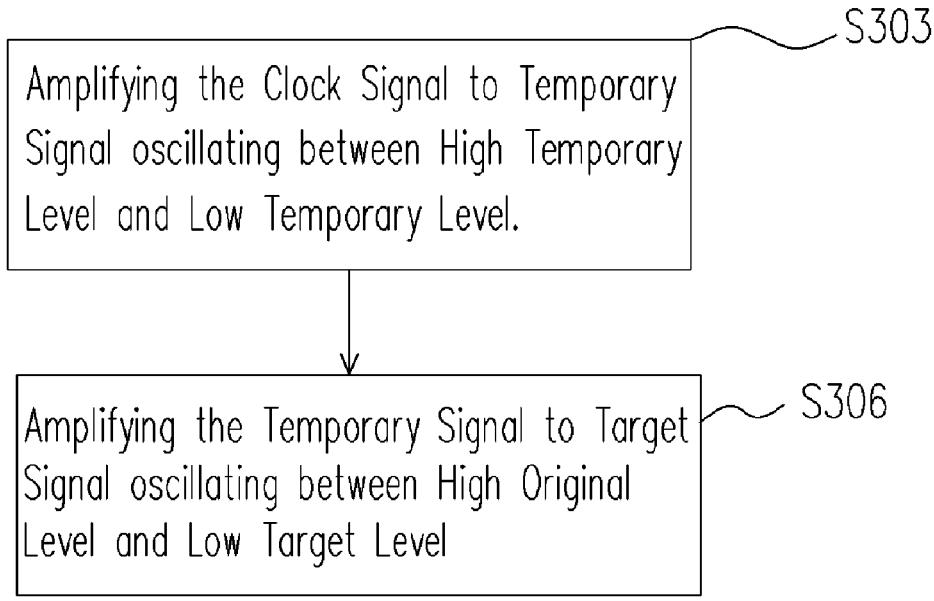
FIG. 3 is a step block diagram illustrating the signal amplifying method for LCD driving circuit according to one preferred embodiment of the present invention.

Referring to FIG. 3, it is a step block diagram illustrating the clock signal amplifying method for LCD driving circuit according to one preferred embodiment of the present invention. In this one preferred embodiment, the clock signal CLK_in that swings between a high original voltage (e.g. 3V) and a low original voltage (e.g. 0V) is amplified to a target signal that swings between a high target level (e.g. 9V) and a low target level (e.g. 5V). Firstly, the clock signal CLK_in is amplified to a relay signal (step S303) that swings between a high relay signal and a low relay signal. Thereafter, the relay signal is amplified to the target signal (step S306). Wherein the high relay level is between the high original level (e.g. 3V) and the high target level (e.g. 9V), whereas the low relay level is between the low original level (e.g. 0V) and low target level (e.g. 5V). In one preferred embodiment of the present invention, the clock signal CLK_in is received during a specific period of time.

Figure 4:
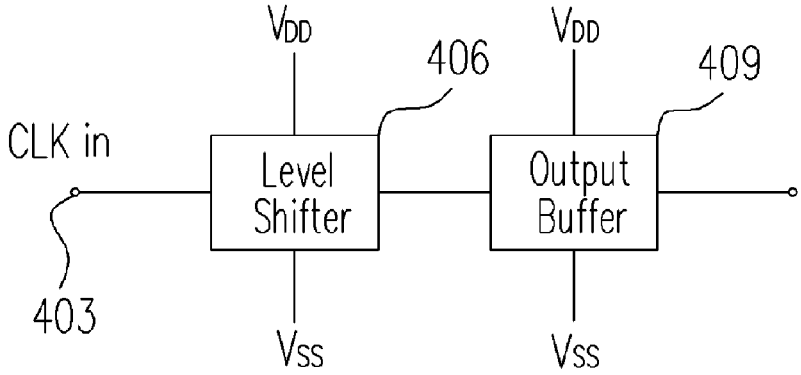
FIG. 4 is block diagram illustrating a clock signal amplifying circuit according to a one preferred embodiment of the present invention.

Referring to FIG. 4, it is block diagram illustrating a clock signal amplifying circuit of LCD driving circuit according to a one preferred embodiment of the present invention. The amplifying circuit in this preferred embodiment includes a clock input 403, a level shifter 406 and an output buffer 409. Wherein the clock input 403 receives a clock signal CLK_in swinging between high original level (e.g. 3V) and low original level (e.g. 0V). The level shifter 406 coupling to the clock input 403 for receiving the clock signal CLK_in is biased at the high target level (e.g. 9V) and low target level (e.g. 5V), so as to amplify the clock signal CLK_in to a relay signal that swings between the high relay level and the low relay level. The output buffer 409 is coupled to the level shifter 406 from which the relay signal is received, is biased at the high target level and the low target level, so as to amplify the relay signal to the target signal that swings between the high target level and the low target level. Wherein the foregoing voltage levels in a high to low order are the high target level, the high relay level, the high original level, the low original level, the low relay level, and the low target level. Wherein the high target level can be 9V, the high original level can be 3V, whereas the low target level can be 5V, and the low original low level can be 0V.

Figure 5A:
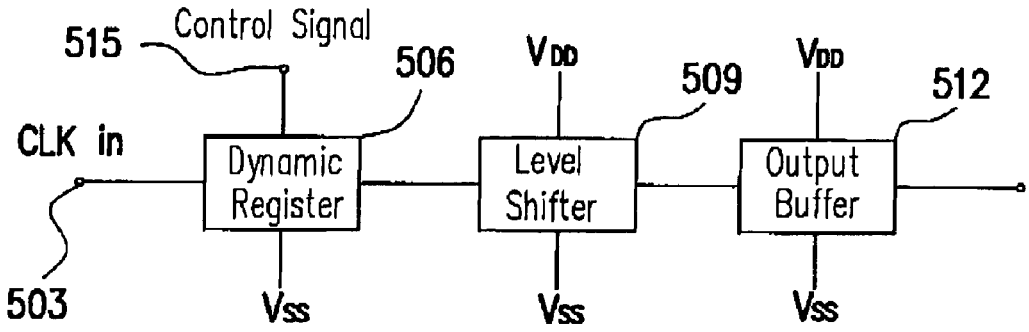
FIG. 5A is a block diagram illustrating a driving stage of LCD driving circuit according to one preferred embodiment of the present invention.
Figure 5B:
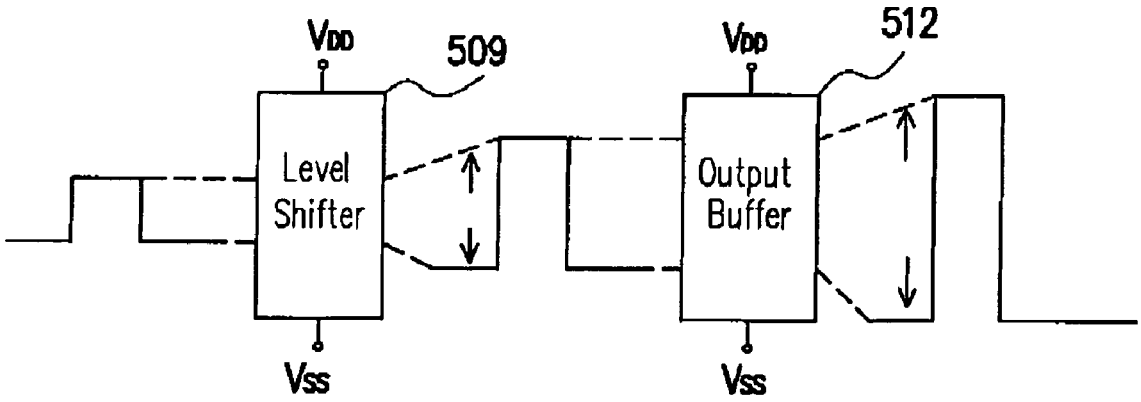
FIG. 5B is a diagram illustrating level shifting of a driving stage of LCD driving circuit according to one preferred embodiment of the present invention.

Referring to FIG. 5A hereafter, it is a block diagram illustrating a driving stage of LCD driving circuit according to one preferred embodiment of the present invention. The driving stage includes a dynamic register 506, which couples the clock input 503 to the level shifter 509, for determining if turning on the path between the clock input 503 and the level shifter 509 upon a control signal 515. Referring to FIG. 5B herein, it is a diagram illustrating level shifting of a driving circuit for LCD driving circuit of the present invention. The operation of the level shifting means is similar to that of FIG. 4. According to formula $P=fcV^2$, dynamic power dissipation is in proportion to square V, which means when the voltage level is half of the original, the power is ideally quarter of the original consumption, thus the driving stage consumes substantially less power on the clock propagation line.

Figure 6A:
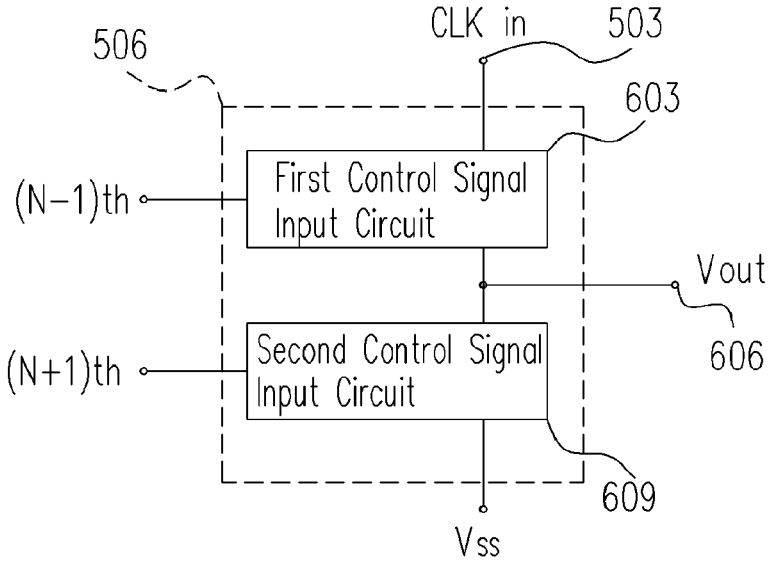
FIG. 6A is a block diagram illustrating a circuit for a dynamic register according to one preferred embodiment of the present invention.

Referring to FIG. 6A, it is a block diagram illustrating a circuit for a dynamic register according to one preferred embodiment of the present invention. The dynamic register 506 therein includes a register output 606, a first control signal input circuit 603 and a second control signal input circuit 609. Wherein, the register output 606 is coupled to the level shifter 509. The first control signal input circuit 603 is for receiving a driving signal from the preceding stage ($N-1^{th}$ stage) of the driving stage, and determining whether to turn on the path between the clock input 503 and the register output 606. Moreover, the second control signal input circuit 609 is for receiving a driving signal from the subsequent stage ($N+1^{th}$ stage) of the driving stage, and determining whether to turn on the path between the register output 606 and the low target level (e.g. 5V).

Figure 6B:
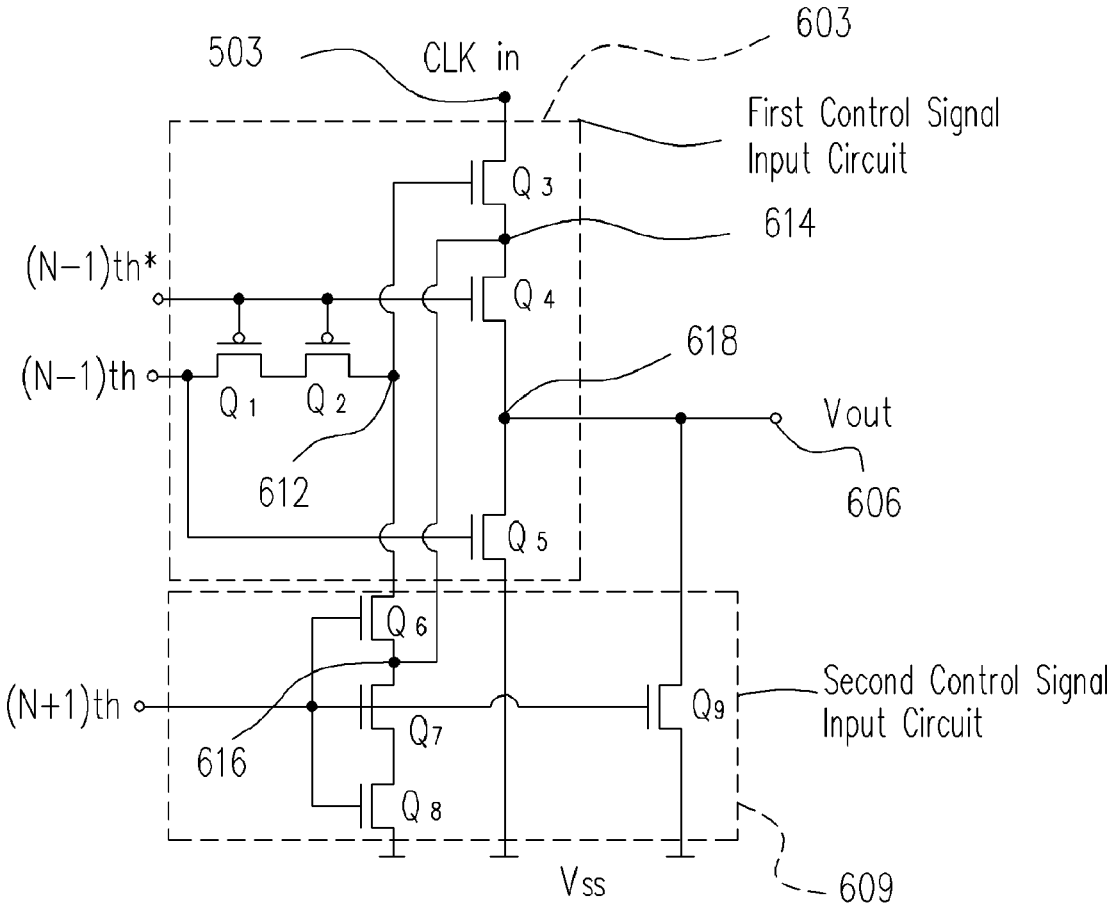
FIG. 6B is a device-level circuit diagram illustrating a dynamic register according to one preferred embodiment of the present invention.

Referring to FIG. 6B, it is a device-level circuit diagram illustrating a dynamic register according to one preferred embodiment of the present invention. Wherein, transistors Q1 and Q2 construct a dual-gate configuration, which functions as an input switch. When the dual-gate configuration is turned on, the preceding stage signal ($N-1^{th}$) charges node 612 to a positive voltage level, which is higher than that of clock input CLK_in. When the dual-gate configuration is off, the node 612 is kept at high voltage level. According to the figure, transistors Q6, Q7 and Q8 is connected in triple-gate configuration, which discharges the node 612 to a negative voltage level when the subsequent stage ($N+1^{th}$) is turned on. Wherein multi-gate configuration is used for reducing leakage current when the node 612 is put to holding time. The operation detail of signals in the present invention is described as follows.

1. When the node 612 is put to charging time, voltage level of $N-1^{th}$*, the complement of preceding driving signal $N-1^{th}$, is 5V which cuts off the transistor Q4, whereas the preceding driving signal $N-1^{th}$ is 9V, which turns on the transistor Q5. The node 618 is kept at 5V, being output terminal of the dynamic register, is coupled to the input terminal of the level shifter.

2. When the node 612 is put to holding time, the preceding driving signal $N-1^{th}$ is 5V, which cuts off the transistor Q5, whereas voltage level of $N-1^{th}$*, the complement of preceding driving signal $N-1^{th}$, is 9V which turns on the transistor Q4. Thus the clock signal CLK_in, swinging between 0V and 3V, is coupled to the node 618. In other words, the node 618 receives the clock signal CLK_in and outputs to the level shifter when the transistors Q3 and Q4 are both turned on.

3. When the node 612 is put to discharging time, when voltage level of the subsequent driving signal $N+1^{th}$ is 9V, the transistors Q6, Q7, Q8 and Q9 are turned on. When the node 612 is discharged to 5V, the transistor Q3 is cut off, where the dynamic register provides a substantially large input impedance to the clock signal CLK_in. Wherein voltage level of the node 618 is kept at 5V, and is not changed until next triggering signal arrives.

Figure 6C:
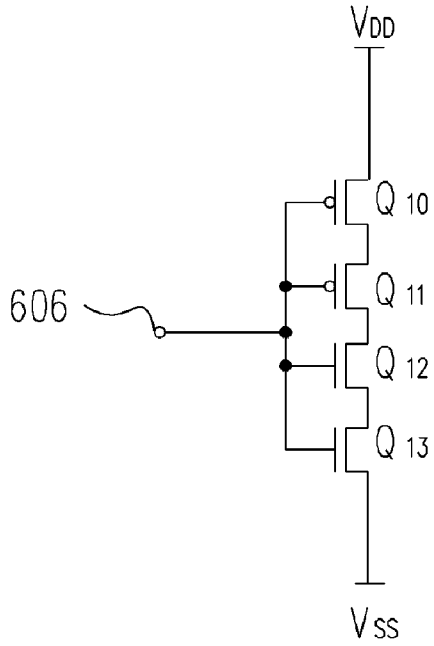
FIG. 6C is a device-level circuit diagram illustrating a level shifter circuit according to one preferred embodiment of the present invention.
Figure 6D:
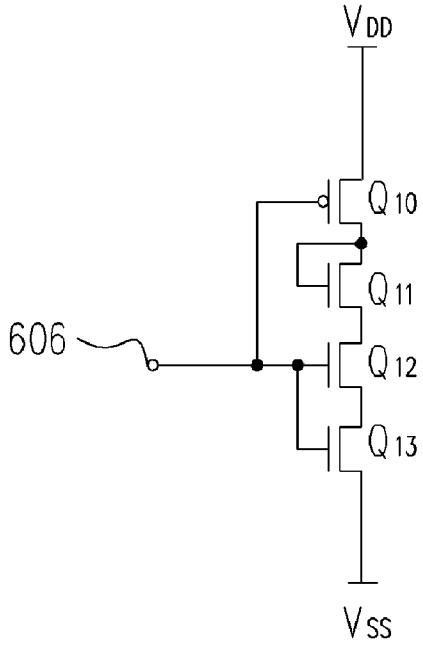
FIG. 6D is a device-level circuit diagram illustrating another level shifter according to one preferred embodiment of the present invention.

Referring to FIGS. 6C and 6D, they are different device-level circuits of a level shifter of a driving stage according to one preferred embodiment of the present invention. For skill in the art, the level shifter includes CMOS inverter. The level shifter further includes a MOS device with drain electrode connecting to gate electrode to act as a load element.

Figure 7A:
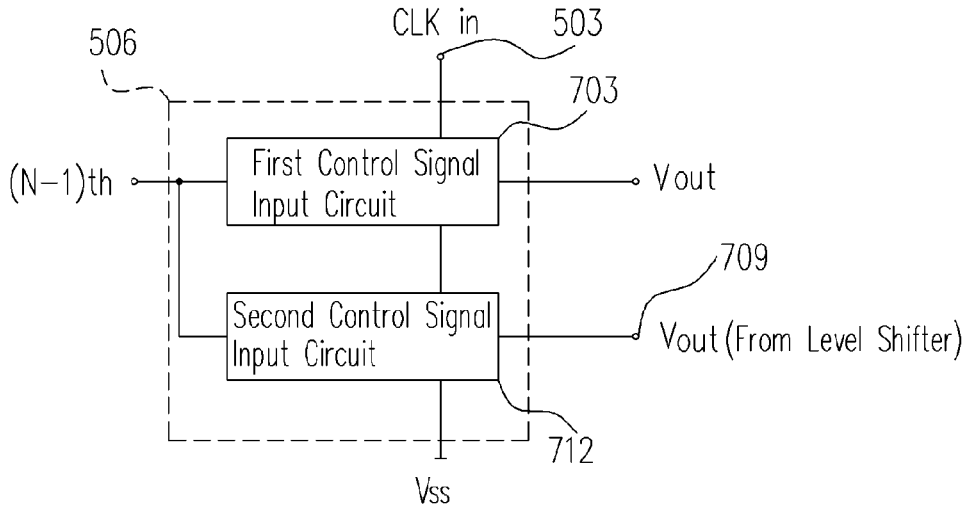
FIG. 7A is a block diagram illustrating a circuit for a dynamic register according to another preferred embodiment of the present invention.

Referring to FIG. 7A, it is a block diagram illustrating a circuit for a dynamic register according to another preferred embodiment of the present invention. The dynamic register includes a register input terminal 709, a first control signal input circuit 703 and a second control signal input circuit 712. In this preferred embodiment, the second control signal input circuit 712 serves to receive the input signal 709 from an output of the level shifter of the present stage, and for determining whether to put the driving stage to the low target level (e.g. 5V). Wherein the output signal 709 of the level shifter is a negative pulsed signal with normally high voltage level of VDD.

Figure 7B:
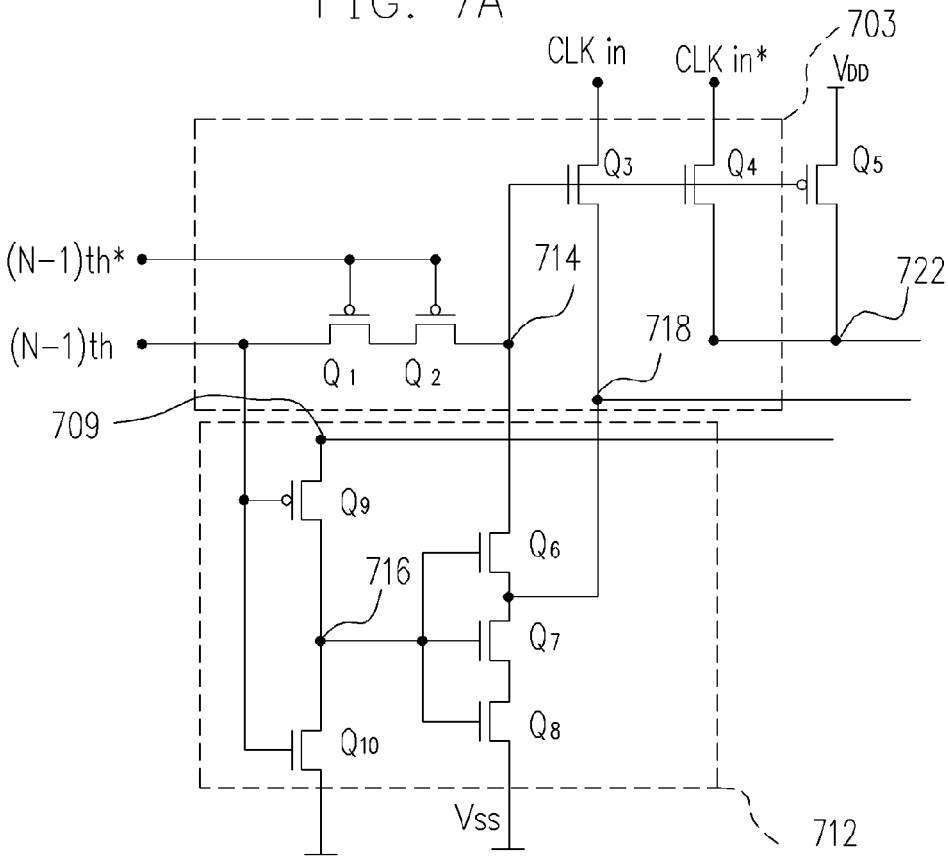
FIG. 7B is a device-level circuit diagram illustrating a dynamic register according to another preferred embodiment of the present invention.

Referring to FIG. 7B, it is a device-level circuit diagram illustrating a dynamic register according to another preferred embodiment of the present invention. During charging time, the dynamic register performs similarly to that of the first preferred embodiment. When the node 714 is put to high voltage level, the transistors Q3 and Q4 are turned on, and the transistor Q5 is cut off, whereas a pair of complement clock signals CLK_in and CLK_in* are fed to the level shifter via the transistors Q3 and Q4. In this preferred embodiment, the level shifter 509 are comprised of two parallel inverse circuits, where the output signal 709 is amplified from the complement clock signal CLK_in* within a time period. The clock signal swings between a high relay level and a low relay level. The high relay level is between 3V and 9V, and the low relay level is between GND and 5V.

Figure 7C:
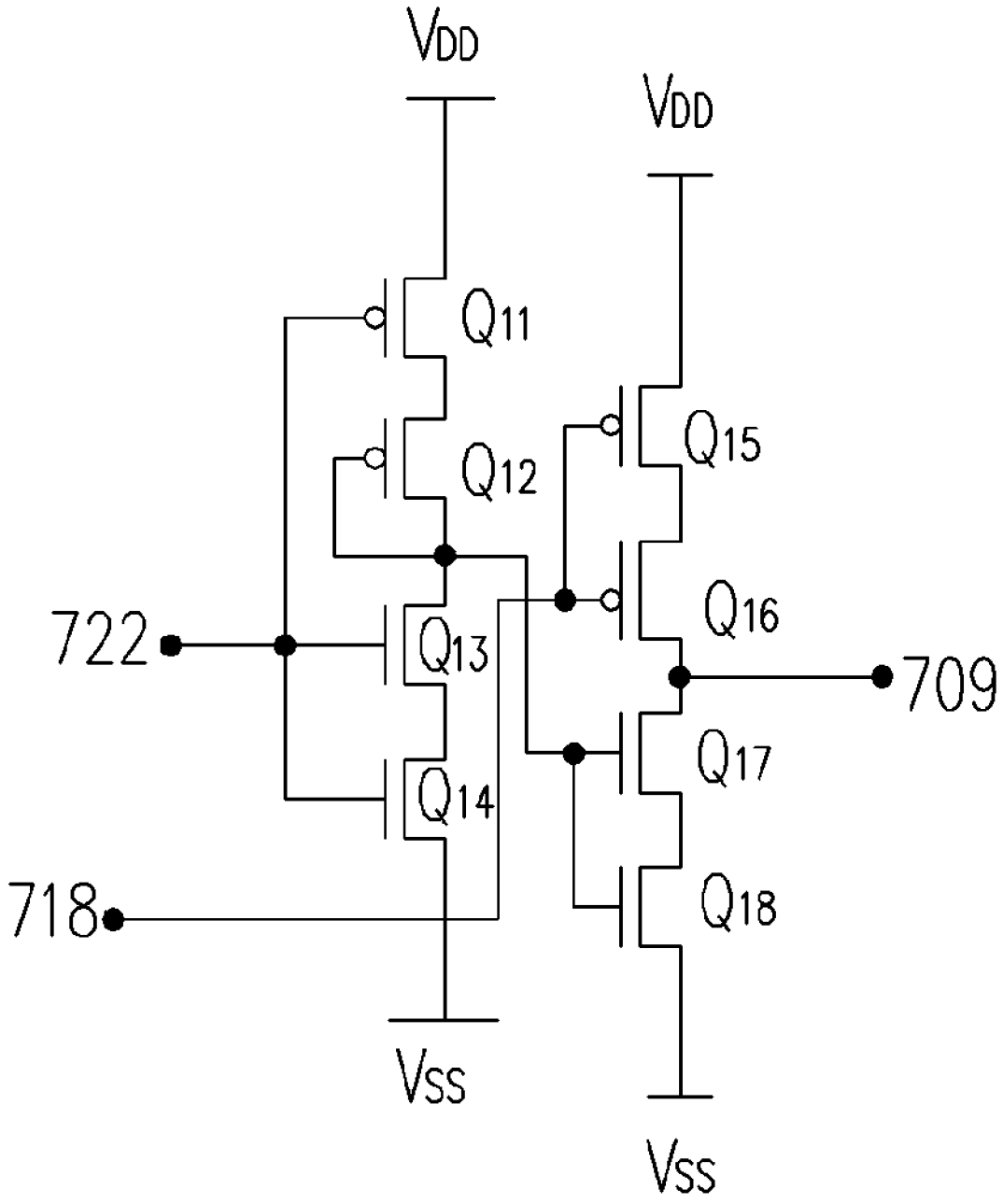
FIG. 7C is a device-level circuit diagram illustrating a level shifter according to another preferred embodiment of the present invention.

Referring to FIG. 7C, it is a device-level circuit diagram illustrating a level shifter of a driver stage according to another preferred embodiment of the present invention. The level shifter is divided into two stages: a first stage including transistors Q11, Q12, Q13, and Q14, and a second stage including transistors Q15, Q16, Q17, and Q18. Wherein the first stage couples to the transistor Q4 for receiving the complement clock signal CLK_in*, and the second stage couples to the transistor Q3 for receiving the clock signal CLK_in.

The dynamic register 506 and the output terminal of the level shifter 590 further include feedback loop, which provides self-discharging function for the dynamic register. When the preceding driving signal N−1th turns on the transistor Q9 to charge the common node 716 of the transistors Q6, Q7, and Q8, a feedback signal from the level shifter output is propagated to the node 709. Usually when voltage level of the preceding driving signal ($N-1^{th}$) is 5V, the transistors Q3, Q4 and Q10 are cut off, and the transistors Q5 and Q9 are turned on. Whereas when the input node 722 of the level shifter is put to 9V, the feedback signal from the level shifter output is at 9V and turns on the transistors Q6, Q7 and Q8 via the transistor Q9 and the common node 716. Subsequently, the nodes 714 and 718 are controlled at a voltage level of 5V, that is, the feedback loop keeps the driving stage at a stable feed-back status.

In the embodiment, the driving stage of LCD driving circuit further includes a voltage level chopper, as the transistor Q5 illustrated in FIG. 7B. This voltage level chopper is coupled between the high target level (e.g. 9V) and the output terminal of the register, so as to determine if putting the output terminal of the register to the high target level according to the preceding driving stage signal ($N-1^{th}$). Notice that this voltage level chopper is implemented with a PMOS, for example.

In both the first and the second preferred embodiments of the present invention, only one level shifter and two voltage sources (i.e. VDD and VSS) are required, which consumes substantially lower number of transistors than that in conventional scheme, where two level shifters and three voltage sources (i.e. VDD, VSS, and GND) are comprised of the driving stage of LCD driving circuit. Furthermore, the dynamic register in the second preferred embodiment includes feedback loop, thus each driving stage can be auto-turn-off and is kept at a stable status.

The above description provides a full and complete description of the preferred embodiments of the present invention. Various modifications, alternate construction, and equivalent may be made by those skilled in the art without changing the scope or spirit of the invention. Accordingly, the above description and illustrations should not be construed as limiting the scope of the invention which is defined by the following claims.

The invention claimed is:

1. A driving stage for an LCD driving circuit, the driving stage being a part of the LCD driving circuit in a cascade fashion, the driving stage comprising:

a clock input terminal, for receiving a clock signal having a first original level and a second original level:

a level shifter, coupled to the clock input terminal, for receiving the clock signal from the clock input terminal, for operating at a first target level and a second target level, and for amplifying the clock signal to a relay signal having a first relay level and a second relay level;

an output buffer, coupled to the level shifter, for receiving the relay signal from the level shifter, for operating at the first target level and the second target level, and for amplifying the relay signal to a target signal having the first target level and the second target level, wherein the first original level is higher than the second original level, the first target level is higher than the second target level, the fast relay level is higher than the first original level but lower than the first target level, and the second relay level is lower than the second original level but higher than the second target level; and a dynamic register, wherein the dynamic register is coupled to the clock input terminal for receiving the clock signal and determines whether the clock signal is provided to the level shifter according to a control signal, the dynamic register comprising:

a register output terminal, coupling to the level shifter;

a first control signal input circuit, receiving a previous stage driving signal from a previous driving stage and determining whether to conduct the clock signal to the register output terminal according to the previous stage driving signal; and a second control signal input circuit, receiving a next stage driving signal from a next driving stage and determining whether to conduct the register output terminal the second target level according to the next stage driving signal.

2. A driving stage for an LCD driving circuit, the driving stage being a part of the LCD driving circuit in a cascade fashion, the driving stage comprising:

a clock input terminal, for receiving a clock signal having a first original level and a second original level;

a level shifter, coupled to the clock input terminal, for receiving the clock signal from the clock input terminal, for operating at a first target level and a second target level, and for amplifying the clock signal to a relay signal having a first relay level, and a second relay level;

an output buffer, coupled to the level shifter, for receiving the relay signal from the level shifter, for operating at the first target level and the second target level, and for amplifying the relay signal to a target signal having the first target level and the second target level, wherein the first original level is higher than the second original level, the first target level is higher than the second target level, the first relay level is higher than the first original level but lower than the first target level, and the second relay level is lower than the second original level but higher than the second target level; and a dynamic register, wherein the dynamic register is coupled to the clock input terminal for receiving the clock signal and determines whether the clock signal is provided to the level shifter according to a control signal, the dynamic register comprising:

a register output terminal, coupling to the level shifter;

a first control signal input circuit, receiving a previous stage driving signal from a previous driving stage and determining whether to conduct the clock signal to the register output terminal according to the previous stage driving signal; and a second control signal input circuit, receiving the previous stage driving signal and output of the level shifter and determining whether to conduct the driving stage to the second target level thereby.

3. The driving stage as recited in claim 2 further comprising:

a level chopper, couples the first target level to the register output terminal, and determines whether to conduct the register output terminal to the first target level according to the previous stage driving signal.

4. The driving stage as recited in claim 3, wherein the level chopper comprises p-type thin film transistor.

* * * * *